US007613606B2

(12) United States Patent
Makinen

(10) Patent No.: US 7,613,606 B2
(45) Date of Patent: Nov. 3, 2009

(54) SPEECH CODECS

(75) Inventor: Jari Makinen, Tampere (FI)

(73) Assignee: Nokia Corporation, Espoo (FI)

( * ) Notice: Subject to any disclaimer, the term of this patent is extended or adjusted under 35 U.S.C. 154(b) by 915 days.

(21) Appl. No.: 10/676,269

(22) Filed: Oct. 2, 2003

(65) Prior Publication Data

US 2005/0075873 A1 Apr. 7, 2005

(51) Int. Cl.
*G10L 11/06* (2006.01)

(52) U.S. Cl. ..... 704/221; 704/229; 704/230

(58) Field of Classification Search ..... 704/221, 704/230, 229
See application file for complete search history.

(56) References Cited

U.S. PATENT DOCUMENTS 5,414,796 A * 5/1995 Jacobs et al. ..... 704/221
6,226,607 B1 * 5/2001 Chang et al. ..... 704/221
6,647,366 B2 * 11/2003 Wang et al. ..... 704/201
2001/0023395 A1 * 9/2001 Su et al. ..... 704/220
2002/0111798 A1 * 8/2002 Huang ..... 704/220
2004/0030548 A1 * 2/2004 El-Maleh et al. ..... 704/230
2004/0228537 A1 * 11/2004 Yeung et al. ..... 382/239

* cited by examiner

*Primary Examiner*—Qi Han
(74) *Attorney, Agent, or Firm*—Squire, Sanders & Dempsey, L.L.P.

(57) ABSTRACT

A method of encoding a frame in a communication network using multiple codec modes, wherein the frame encoded by each codec mode is represented by multiple parameters. The method includes at least one stage, wherein the stage includes the steps of selecting one group from multiple groups of codec modes, wherein each group includes at least one codec mode and is arranged to have a common parameter characteristic. The method further includes encoding the frame with one of the codec modes from the selected group in dependence on the common parameter characteristic.

21 Claims, 5 Drawing Sheets

| PARAMETER | CODEC MODE [kbit/s] | | | | | | | | |
|---|---|---|---|---|---|---|---|---|---|
| | 6.60 | 8.85 | 12.65 | 14.25 | 15.85 | 18.25 | 19.85 | 23.05 | 23.85 |
| *VAD flag* | 1 | 1 | 1 | 1 | 1 | 1 | 1 | 1 | 1 |
| *LTP filtering flag* | 0 | 0 | 4 | 4 | 4 | 4 | 4 | 4 | 4 |
| *ISP* | 36 | 46 | 46 | 46 | 46 | 46 | 46 | 46 | 46 |
| *Pitch delay* | 23 | 26 | 30 | 30 | 30 | 30 | 30 | 30 | 30 |
| *Algebraic CB* | 48 | 80 | 144 | 176 | 208 | 256 | 288 | 352 | 352 |
| *Gains* | 24 | 24 | 28 | 28 | 28 | 28 | 28 | 28 | 28 |
| *High-band energy* | 0 | 0 | 0 | 0 | 0 | 0 | 0 | 0 | 16 |
| *Total per frame* | **132** | **177** | **253** | **285** | **317** | **365** | **397** | **461** | **477** |

Fig.4

SPEECH CODECS

FIELD OF INVENTION

The present invention relates to speech encoding in a communication system.

BACKGROUND TO THE INVENTION

Cellular communication networks are commonplace today. Cellular communication networks typically operate in accordance with a given standard or specification. For example, the standard or specification may define the communication protocols and/or parameters that shall be used for a connection. Examples of the different standards and/or specifications include, without limiting to these, GSM (Global System for Mobile communications), GSM/EDGE (Enhanced Data rates for GSM Evolution), AMPS (American Mobile Phone System), WCDMA (Wideband Code Division Multiple Access) or 3rd generation (3G) UMTS (Universal Mobile Telecommunications System), IMT 2000 (International Mobile Telecommunications 2000) and so on.

In a cellular communication network, voice data is typically captured as an analogue signal, digitised in an analogue to digital (A/D) converter and then encoded before transmission over the wireless air interface between a user equipment, such as a mobile station, and a base station. The purpose of the encoding is to compress the digitised signal and transmit it over the air interface with the minimum amount of data whilst maintaining an acceptable signal quality level. This is particularly important as radio channel capacity over the wireless air interface is limited in a cellular communication network. The sampling and encoding techniques used are often referred to as speech encoding techniques or speech codecs.

Often speech can be considered as bandlimited to between approximately 200 Hz and 3400 Hz. The typical sampling rate used by a A/D converter to convert an analogue speech signal into a digital signal is either 8 kHz or 16 kHz. The sampled digital signal is then encoded, usually on a frame by frame basis, resulting in a digital data stream with a bit rate that is determined by the speech codec used for encoding. The higher the bit rate, the more data is encoded, which results in a more accurate representation of the input speech frame. The encoded speech can then be decoded and passed through a digital to analogue (D/A) converter to recreate the original speech signal.

An ideal speech codec will encode the speech with as few bits as possible thereby optimising channel capacity, while producing decoded speech that sounds as close to the original speech as possible. In practice there is usually a trade-off between the bit rate of the codec and the quality of the decoded speech.

In today's cellular communication networks, speech encoding can be divided roughly into two categories: variable rate and fixed rate encoding.

In variable rate encoding, a source based rate adaptation (SBRA) algorithm is used for classification of active speech. Speech of differing classes are encoded by different speech modes, each operating at a different rate. The speech modes are usually optimised for each speech class. An example of variable rate speech encoding is the enhanced variable rate speech codec (EVRC).

In fixed rate speech encoding, voice activity detection (VAD) and discontinuous transmission (DTX) functionality is utilised, which classifies speech into active speech and silence periods. During detected silence periods, transmission is performed less frequently to save power and increase network capacity. For example, in GSM during active speech every speech frame, typically 20 ms in duration, is transmitted, whereas during silence periods, only every eighth speech frame is transmitted. Typically, active speech is encoded at a fixed bit rate and silence periods with a lower bit rate.

Multi-rate speech codecs, such as the adaptive multi-rate (AMR) codec and the adaptive multi-rate wideband (AMR-WB) codec were developed to include VAD/DTX functionality and are examples of fixed rate speech encoding. The bit rate of the speech encoding, also known as the codec mode, is based factors such as the network capacity and radio channel conditions of the air interface.

AMR was developed by the 3rd Generation Partnership Project (3GPP) for GSM/EDGE and WCDMA communication networks. In addition, it has also been envisaged that AMR will be used in future packet switched networks. AMR is based on Algebraic Code Excited Linear Prediction (ACELP) coding. The AMR and AMR WB codecs consist of 8 and 9 active bit rates respectively and also include VAD/DTX functionality. The sampling rate in the AMR codec is 8 kHz. In the AMR WB codec the sampling rate is 16 kHz.

ACELP coding operates using a model of how the signal source is generated, and extracts from the signal the parameters of the model. More specifically, ACELP coding is based on a model of the human vocal system, where the throat and mouth are modelled as a linear filter and speech is generated by a periodic vibration of air exciting the filter. The speech is analysed on a frame by frame basis by the encoder and for each frame a set of parameters representing the modelled speech is generated and output by the encoder. The set of parameters may include excitation parameters and the coefficients for the filter as well as other parameters. The output from a speech encoder is often referred to as a parametric representation of the input speech signal. The set of parameters is then used by a suitably configured decoder to regenerate the input speech signal.

Details of the AMR and AMR-WB codecs can be found in the 3GPP TS 26.090 and 3GPP TS 26.190 technical specifications. Further details of the AMR-WB codec and VAD can be found in the 3GPP TS 26.194 technical specification. All the above documents are incorporated herein by reference.

Both AMR and AMR-WB codecs are multi rate codecs with independent codec modes or bit rates. In both the AMR and AMR-WB codecs, the mode selection is based on the network capacity and radio channel conditions. However, the codecs may also be operated using a variable rate scheme such as SBRA where the codec mode selection is further based on the speech class. The codec mode can then be selected independently for each analysed speech frame (at 20 ms intervals) and may be dependent on the source signal characteristics, average target bit rate and supported set of codec modes. The network in which the codec is used may also limit the performance of SBRA. For example, in GSM, the codec mode can be changed only once every 40 ms.

By using SBRA, the average bit rate may be reduced without any noticeable degradation in the decoded speech quality. The advantage of lower average bit rate is lower transmission power and hence higher overall capacity of the network.

Typical SBRA algorithms determine the speech class of the sampled speech signal based on speech characteristics. These speech classes may include low energy, transient, unvoiced and voice sequences. The subsequent speech encoding is dependent on the speech class. Therefore, the accuracy of the speech classification is important as it determines the speech encoding and associated encoding rate. In previously known systems, the speech class is determined before speech encoding begins.

Furthermore, the AMR and AMR-WB codecs may utilise SBRA together with VAD/DTX functionality to lower the bit rate of the transmitted data during silence periods. During periods of normal speech, standard SBRA techniques are used to encode the data. During silence periods, VAD detects the silence and interrupts transmission (DTX) thereby reducing the overall bit rate of the transmission.

Although effective, SBRA algorithms are very complex and require a large amount of memory and resources to implement. As such, their usage has so far been limited due to the substantial overheads.

It is the aim of embodiments of the present invention to provide an improved speech encoding method that at least partly mitigates some of the above problems.

SUMMARY OF THE INVENTION

In accordance with a first aspect of the present invention there is provided a method of encoding a frame in a communication network using a plurality of codec modes, wherein the frame encoded by each codec mode is represented by a plurality of parameters, said method comprising at least one stage and wherein said at least one stage comprises the steps of selecting from a plurality of groups of codec modes one group, wherein each group comprises at least one codec mode and is arranged to have a common parameter characteristic and encoding the frame with one of the codec modes from the selected group in dependence on said common parameter characteristic.

In accordance with another aspect of the present invention there is provided an apparatus for encoding a frame in a communication network using a plurality of codec modes, wherein the frame encoded by each codec mode is represented by a plurality of parameters, said apparatus comprising at least one stage and wherein said at least one stage comprises means for selecting from a plurality of groups of codec modes one group, wherein each group comprises at least one codec mode and is arranged to have a common parameter characteristic and means for encoding the frame with one of the codec modes from the selected group in dependence on said common parameter characteristic.

In accordance with yet another aspect of the present invention there is provided a method of determining a codec mode for encoding a frame in a communication system, wherein the communication system comprises a voice activity detection module for detecting silent frames and a codec mode selection module, said method comprising receiving at the voice activity detection module a frame; determining at the voice activity detection module a first set of parameters from the frame; providing the first set of parameters to the codec mode selection module; determining at the codec mode selection module a second set of parameters in dependence on the first set of parameters; and selecting a codec mode for encoding the frame at the codec mode selection module in dependence on the second set of parameters;

In accordance with yet another aspect of the present invention there is provided an apparatus for determining a codec mode for encoding a frame in a communication system, the apparatus comprising a voice activity detection module for detecting silent frames and a codec mode selection module for determining a codec mode; and said voice activity detection module comprising: means for receiving a frame; means for determining a first set of parameters from the frame; and means for providing the first set of parameters to the codec mode selection module; said codec mode selection module comprising: means for determining a second set of parameters in dependence on the first set of parameters; and means for selecting a codec mode in dependence on the second set of parameters;

BRIEF DESCRIPTION OF DRAWINGS

For a better understanding of the present invention reference will now be made by way of example only to the accompanying drawings, in which:

FIG. 4 illustrates a bit allocation table of coding modes in a preferred embodiment of the present invention;

DETAILED DESCRIPTION OF EMBODIMENTS

The present invention is described herein with reference to particular examples. The invention is not, however, limited to such examples.

Figure 1:
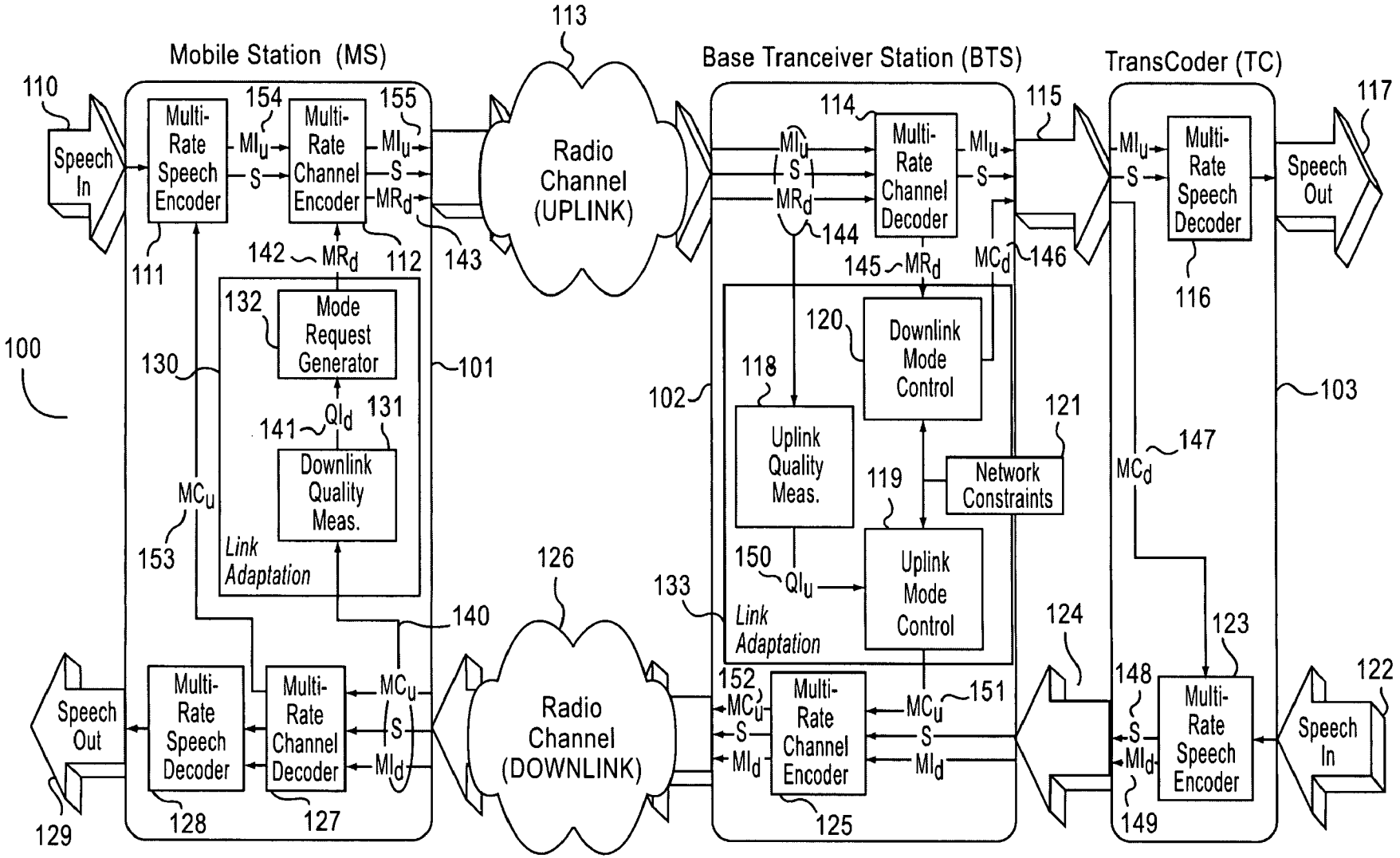
FIG. 1 illustrates a communication network in which embodiments of the present invention can be applied.

FIG. 1 illustrates a typical cellular telecommunication network 100 that supports an AMR speech codec. The network 100 comprises various network elements including a mobile station (MS) 101, a base transceiver station (BTS) 102 and a transcoder (TC) 103. The MS communicates with the BTS via the uplink radio channel 113 and the downlink radio channel 126. The BTS and TC communicate with each other via communication links 115 and 124. The BTS and TC form part of the core network. For a voice call originating from the MS, the MS receives speech signals 110 at a multi-rate speech encoder module 111.

In this example, the speech signals are digital speech signals converted from analogue speech signals by a suitably configured analogue to digital (A/D) converter (not shown). The multi-rate speech encoder module encodes the digital speech signal 110 into a speech encoded signal on a frame by frame basis, where the typical frame duration is 20 ms. The speech encoded signal is then transmitted to a multi-rate channel encoder module 112. The multi-rate channel encoder module further encodes the speech encoded signal from the multi-rate speech encoder module. The purpose of the multi-rate channel encoder module is to provide coding for error detection and/or error correction purposes. The encoded signal from the multi-rate channel encoder is then transmitted across the uplink radio channel 113 to the BTS. The encoded signal is received at a multi-rate channel decoder module 114, which performs channel decoding on the received signal. The channel decoded signal is then transmitted across communication link 115 to the TC 103. In the TC 103, the channel decoded signal is passed into a multi-rate speech decoder module 116, which decodes the input signal and outputs a digital speech signal 117 corresponding to the input digital speech signal 110.

A similar sequence of steps to that of a voice call originating from a MS to a TC occurs when a voice call originates from the core network side, such as from the TC via the BTS to the MS. When the voice calls starts from the TC, the speech signal 122 is directed towards a multi-rate speech encoder module 123, which encodes the digital speech signal 122. The speech encoded signal is transmitted from the TC to the BTS via communication link 124. At the BTS, it is received at a multi-rate channel encoder module 125. The multi-rate channel encoder module 125 further encodes the speech encoded signal from the multi-rate speech encoder module 123 for error detection and/or error correction purposes. The encoded signal from the multi-rate channel encoder module is transmitted across the downlink radio channel 126 to the MS. At the MS, the received signal is fed into a multi-rate channel decoder module 127 and then into a multi-rate speech decoder module 128, which perform channel decoding and speech decoding respectively. The output signal from the multi-rate speech decoder is a digital speech signal 129 corresponding to the input digital speech signal 122.

Link adaptation may also take place in the MS and BTS. Link adaptation selects the AMR multirate speech codec mode according to transmission channel conditions. If the transmission channel conditions are poor, the number of bits used for speech encoding can be decreased (lower bit rate) and the number of bits used for channel encoding can be increased to try and protect the transmitted information. However, if the transmission channel conditions are good, the number of bits used for channel encoding can be decreased and the number of bits used for speech encoding increased to give a better speech quality.

The MS may comprise a link adaptation module 130, which takes data 140 from the downlink radio channel to determine a preferred downlink codec mode for encoding the speech on the downlink channel. The data 140 is fed into a downlink quality measurement module 131 of the link adaptation module 130, which calculates a quality indicator message for the downlink channel, $QI_d$. $QI_d$ is transmitted from the downlink quality measurement module 131 to a mode request generator module 132 via connection 141. Based on $QI_d$, the mode request generator module 132 calculates a preferred codec mode for the downlink channel 126. The preferred codec mode is transmitted in the form of a codec mode request message for the downlink channel $MR_d$ to the multi-rate channel encoder 112 module via connection 142. The multi-rate channel encoder 112 module transmits $MR_d$ through the uplink radio channel to the BTS.

In the BTS, $MR_d$ may be transmitted via the multi-rate channel decoder module 114 to a link adaptation module 133. Within the link adaptation module in the BTS, the codec mode request message for the downlink channel $MR_d$ is translated into a codec mode request message for the downlink channel $MC_d$. This function may occur in the downlink mode control module 120 of the link adaptation module 133. The downlink mode control module transmits $MC_d$ via connection 146 to communications link 115 for transmission to the TC.

In the TC, $MC_d$ is transmitted to the multi-rate speech encoder module 123 via connection 147. The multi-rate speech encoder module 123 can then encode the incoming speech 122 with the codec mode defined by $MC_d$. The encoded speech, encoded with the adapted codec mode defined by $MC_d$, is transmitted to the BTS via connection 148 and onto the MS as described above. Furthermore, a codec mode indicator message for the downlink radio channel $MI_d$ may be transmitted via connection 149 from the multi-rate speech encoder module 123 to the BTS and onto the MS, where it is used in the decoding of the speech in the multi-rate speech decoder 127 at the MS.

A similar sequence of steps to link adaptation for the downlink radio channel may also be utilised for link adaptation of the uplink radio channel. The link adaptation module 133 in the BTS may comprise an uplink quality measurement module 118, which receives data from the uplink radio channel and determines a quality indicator message, $QI_u$, for the uplink radio channel. $QI_u$ is transmitted from the uplink quality measurement module 118 to the uplink mode control module 119 via connection 150. The uplink mode control module 119 receives $QI_u$ together with network constraints from the network constraints module 121 and determines a preferred codec mode for the uplink encoding. The preferred codec mode is transmitted from the uplink control module 119 in the form of a codec mode command message for the uplink radio channel $MC_u$ to the multi-rate channel encoder module 125 via connection 151. The multi-rate channel encoder module 125 transmits $MC_u$ together with the encoded speech signal over the downlink radio channel to the MS.

In the MS, $MC_u$ is transmitted to the multi-rate channel decoder module 127 and then to the multi-rate speech encoder 111 via connection 153, where it is used to determine a codec mode for encoding the input speech signal 110. As with the speech encoding for the downlink radio channel, the multi-rate speech coder module for the uplink radio channel generates a codec mode indicator message for the uplink radio channel $M_u$. $MI_u$ is transmitted from the multi-rate speech encoder control module 111 to the multi-rate channel encoder module 112 via connection 154, which in turn transmits $M_u$ via the uplink radio channel to the BTS and then to the TC. $M_u$ is used at the TC in the multi-rate speech decoder module 116 to decode the received encoded speech with a codec mode determined by $M_u$.

Figure 2:
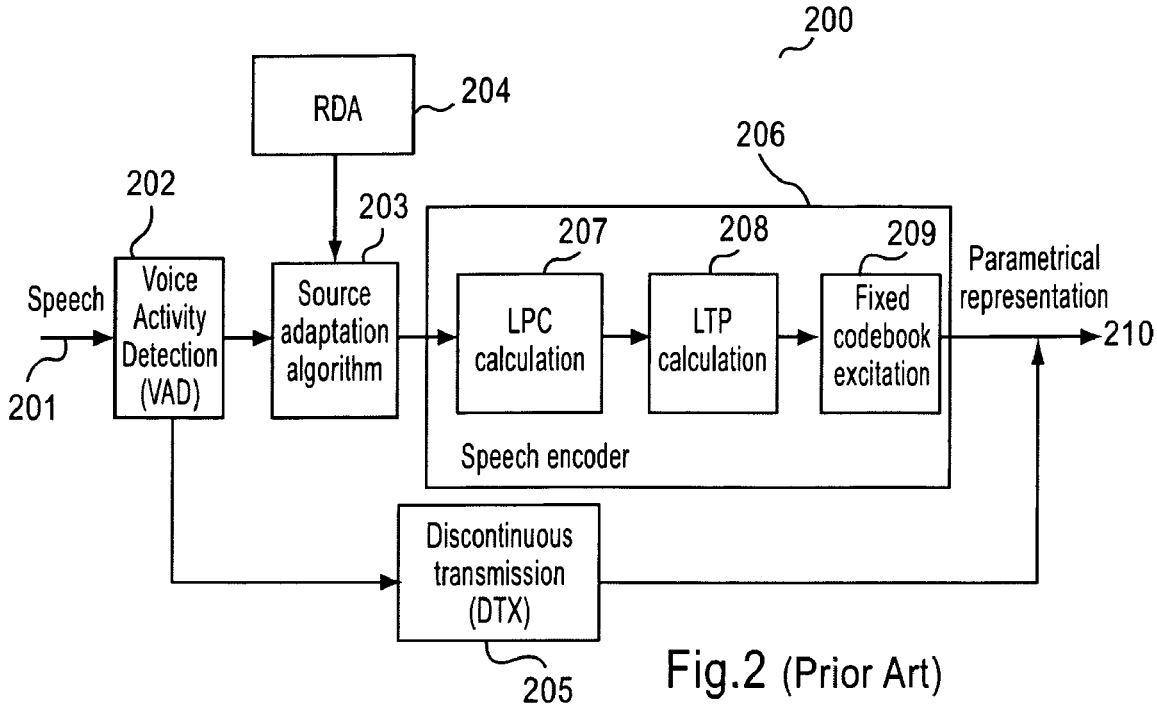
Fig.2 (Prior Art)
FIG. 2 illustrates a block diagram of a prior art arrangement.

FIG. 2 illustrates a block diagram of the multi-rate speech encoder module 111 and 123 of FIG. 1 in the prior art. The multi-rate speech encoder module 200 may operate according to an AMR-WB codec and comprise a voice activity detection (VAD) module 202, which is connected to both a source based rate adaptation (SBRA) algorithm module 203 and a discontinuous transmission (DTX) module 205. The VAD module receives a digital speech signal 201 and determines whether the signal comprises active speech or silence periods. During a silence period, the DTX module is activated and transmission interrupted for the duration of the silence period. During periods of active speech, the speech signal may be transmitted to the SBRA algorithm module. The SBRA algorithm module is controlled by the RDA module 204. The RDA module defines the used average bit rate in the network and sets the target average bit rate for the SBRA algorithm module. The SBRA algorithm module receives speech signals and determines a speech class for the speech signal based on its speech characteristics. The SBRA algorithm module is connected to a speech encoder 206, which encodes the speech signal received from the SBRA algorithm module with a codec mode based on the speech class selected by the SBRA algorithm module. The speech encoder operates using Algebraic Code Excited Linear Prediction (ACELP) coding.

The codec mode selection may depend on many factors. For example, low energy speech sequences may be classified and coded with a low bit rate codec mode without noticeable degradation in speech quality. On the other hand, during transient sequences, where the signal fluctuates, the speech quality can degrade rapidly if codec modes with lower bit rates are used. Coding of voiced and unvoiced speech sequences may also be dependent on the frequency content of the sequence. For example, a low frequency speech sequence can be coded with a lower bit rate without speech quality degradation, whereas high frequency voice and noise-like, unvoiced sequences may need a higher bit rate representation.

The speech encoder 206 in FIG. 2 comprises a linear prediction coding (LPC) calculation module 207, a long term prediction (LTP) calculation module 208 and a fixed code book excitation module 209. The speech signal is processed by the LPC calculation module, LTP calculation module and fixed code book excitation module on a frame by frame basis, where each frame is typically 20 ms long. The output of the speech encoder consists of a set of parameters representing the input speech signal.

Specifically, the LPC calculation module 207 determines the LPC filter corresponding to the input speech frame by minimising the residual error of the speech frame. Once the LPC filter has been determined, it can be represented by a set of LPC filter coefficients for the filter.

The LPC filter coefficients are quantized by the LPC calculation module before transmission. The main purpose of quantization is to code the LPC filter coefficients with as few bits as possible without introducing additional spectral distortion. Typically, LPC filter coefficients, $\{a_1, \ldots, a_p\}$, are transformed into a different domain, before quantization. This is done because direct quantization of the LPC filter, specifically an infinite impulse response (IIR) filter, coefficients may cause filter instability. Even slight errors in the IIR filter coefficients can cause significant distortion throughout the spectrum of the speech signal.

The LPC calculation module coverts the LPC filter coefficients into the immitance spectral pair (ISP) domain before quantization. However, the ISP domain coefficients may be further converted into the immitance spectral frequency (ISF) domain before quantization.

The LTP calculation module 208 calculates an LTP parameter from the LPC residual. The LTP parameter is closely related to the fundamental frequency of the speech signal and is often referred to as a "pitch-lag" parameter or "pitch delay" parameter, which describes the periodicity of the speech signal in terms of speech samples. The pitch-delay parameter is calculated by using an adaptive codebook by the LTP calculation module.

A further parameter, the LTP gain is also calculated by the LTP calculation module and is closely related to the fundamental periodicity of the speech signal. The LTP gain is an important parameter used to give a natural representation of the speech. Voiced speech segments have especially strong long-term correlation. This correlation is due to the vibrations of the vocal cords, which usually have a pitch period in the range from 2 to 20 ms.

The fixed code book excitation module 209 calculates the excitation signal, which represents the input to the LPC filter. The excitation signal is a set of parameters represented by innovation vectors with a fixed codebook combined with the LTP parameter. In a fixed codebook, algebraic code is used to populate the innovation vectors. The innovation vector contains a small number of nonzero pulses with predefined interlaced sets of potential positions. The excitation signal is sometimes referred to as algebraic codebook parameter.

The output from the speech encoder 210 in FIG. 2 is an encoded speech signal represented by the parameters determined by the LPC calculation module, the LTP calculation module and the fixed code book excitation module, which include:

1. LPC parameters quantised in ISP domain describing the spectral content of the speech signal;
2. LTP parameters describing the periodic structure of the speech signal;
3. ACELP excitation quantisation describing the residual signal after the linear predictors.
4. Signal gain.

The bit rate of the codec mode used by the speech encoder may affect the parameters determined by the speech encoder. Specifically, the number of bits used to represent each parameter varies according to the bit rate used. The higher the bit rate, the more bits may be used to represent some or all of the parameters, which may result in a more accurate representation of the input speech signal.

FIG. 4 illustrates a bit allocation table for the codec modes in the AMR-WB codec. The table illustrates the number of bits required to represent the speech encoder parameters corresponding to the different codec modes. The columns indicate the codec modes: 6.60, 8.85, 12.65, 14.25, 15.85, 18.25, 19.85, 23.05 and 23.85 kbit/s. The rows indicate the parameters output by the encoder for each codec mode: a VAD flag, a LTP filtering flag, ISP, pitch delay, algebraic CB (codebook), gains and high-band energy. For example, the number of bits required for representing the LTP filtering flag parameter and the gain parameter when the 15.85 kbit/s codec mode is selected is 4 and 28 bits respectively.

The parameters illustrated in FIG. 4 represent the encoded speech signal, and each may be generated by the speech encoder or transmitted to the speech encoder before encoding begins. For example, the VAD flag may be set by the VAD module 202 before onward transmission to the speech encoder. The ISP parameter represents the LPC filter coefficients and is typically calculated by the LPC calculation module 207. The LTP filtering flag parameter, the pitch delay parameter and the gain parameter are typically calculated by the LTP calculation module 208. The algebraic CB parameter is typically calculated by the fixed codebook excitation module 209. The high-band energy parameter represents the high band energy gain of the encoded speech signal.

All the parameters representing encoded speech signal may be transmitted to a speech decoder together with codec mode information for decoding of the encoded speech signal.

Figure 3:
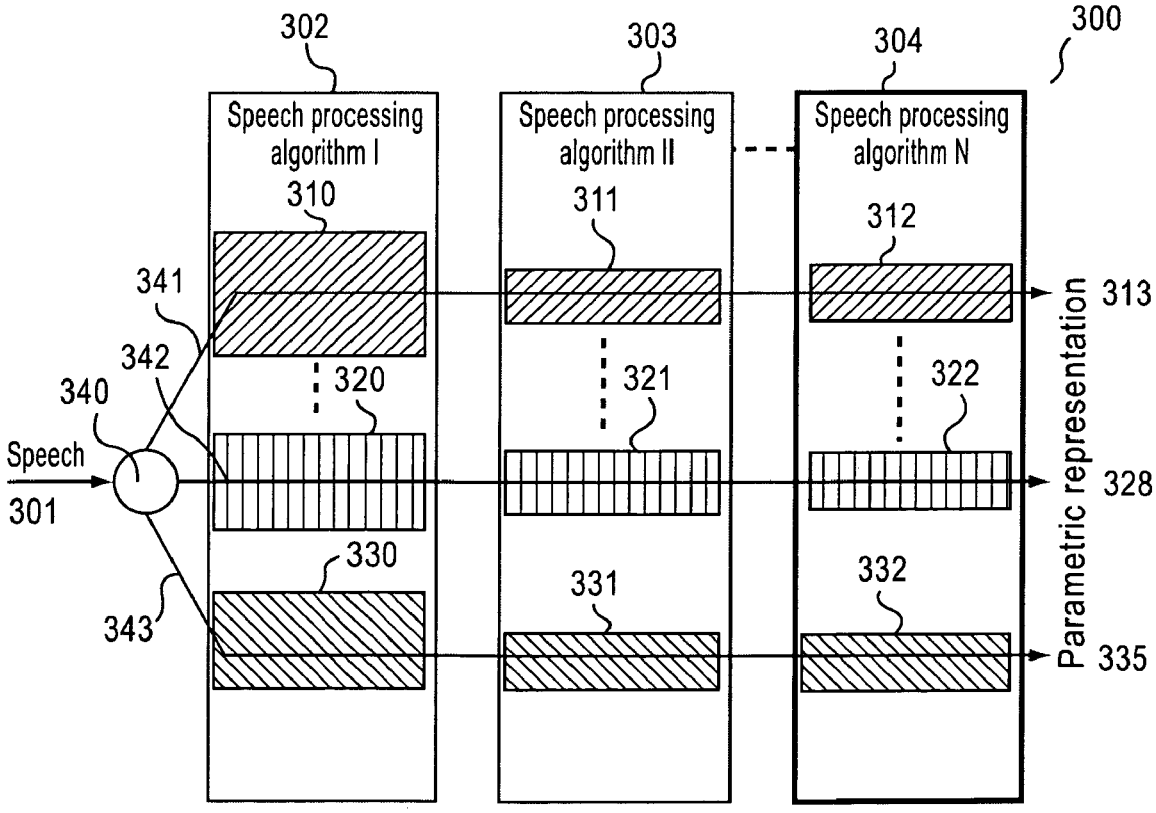
Fig.3 (Prior Art)
FIG. 3 illustrates a signal flow diagram of an arrangement of the prior art.

FIG. 3 is a signal flow diagram illustrating the processing for a speech frame taking place at the SBRA algorithm module and the speech encoder of FIG. 2.

A speech frame 301 is processed by the SBRA algorithm module 340, where a codec mode is selected prior to speech encoding. In this example, there are three codec modes: a first codec mode 341, a second codec mode 342 and a third codec mode 343. It should be appreciated that other codec modes may be present that are not illustrated in FIG. 3.

For each codec mode, speech encoding is performed by a plurality of speech processing algorithm groups on the speech frame. There are N speech processing algorithm groups: speech processing algorithm group I, 302, speech processing algorithm group II, 303, and speech processing algorithm group N, 304 illustrated in FIG. 3. It should be appreciated that other speech processing algorithm groups may be present that are not illustrated in FIG. 3. Each of the speech processing algorithm groups perform one of LPC calculations, LTP calculations and excitation calculations and may be implemented in the LPC calculation module, LTP calculation module and fixed code book excitation module described in FIG. 2.

Each speech algorithm group comprises a plurality of speech processing algorithms. Each speech processing algorithm may perform different calculations and/or calculate different speech encoding parameters. The speech encoding parameters calculated by each of the speech processing algorithms of a speech algorithm group may vary in their characteristics of bit size.

Speech processing algorithm group I comprises speech processing algorithm I-A, 310, speech processing algorithm I-B, 320, and speech processing algorithm I-C, 330. Speech processing algorithm group II comprises speech processing algorithm II-A, 311, speech processing algorithm II-B, 321, and speech processing algorithm II-C, 331. Speech processing algorithm group N comprises speech processing algorithm N-A, 312, speech processing algorithm N-B, 322, and speech processing algorithm N-C, 332.

The selection of the codec mode at the SBRA algorithm module determines which of the speech processing algorithms are used to encode the speech frame. For example, in FIG. 3, a speech frame using the first speech codec 341 is encoded by speech processing algorithm I-A, 310, speech processing algorithm II-A, 311, and speech processing algorithm N-A, 312. A speech frame using the second speech codec 342 is encoded by speech processing algorithm I-B, 320, speech processing algorithm II-B, 321, and speech processing algorithm N-B, 322. A speech frame using the third speech codec 343 is encoded by speech processing algorithm I-C, 330, speech processing algorithm II-C, 331, and speech processing algorithm N-C, 332.

The encoded speech frame for the first codec mode is output as a parametric representation 313. The encoded speech frame for the second codec mode is output as a parametric representation 323. The encoded speech frame for the third codec mode is output as a parametric representation 333.

The decision made by the SBRA algorithm module on which one of the codec modes to select fixes the speech algorithms used for processing the speech frame. This decision is made before speech encoding is started.

In a preferred embodiment of the present invention, the decision as to which speech codec mode to select is delayed. The delay to the decision is dependent on the speech encoder structure. The delay to the decision may result in a more accurate or appropriate selection of the codec mode compared to previously known methods such as those illustrated in FIGS. 2 and 3 above and the total processing required may also be reduced. Preferred embodiments of the present invention utilise a branched SBRA algorithm approach.

Figure 5:
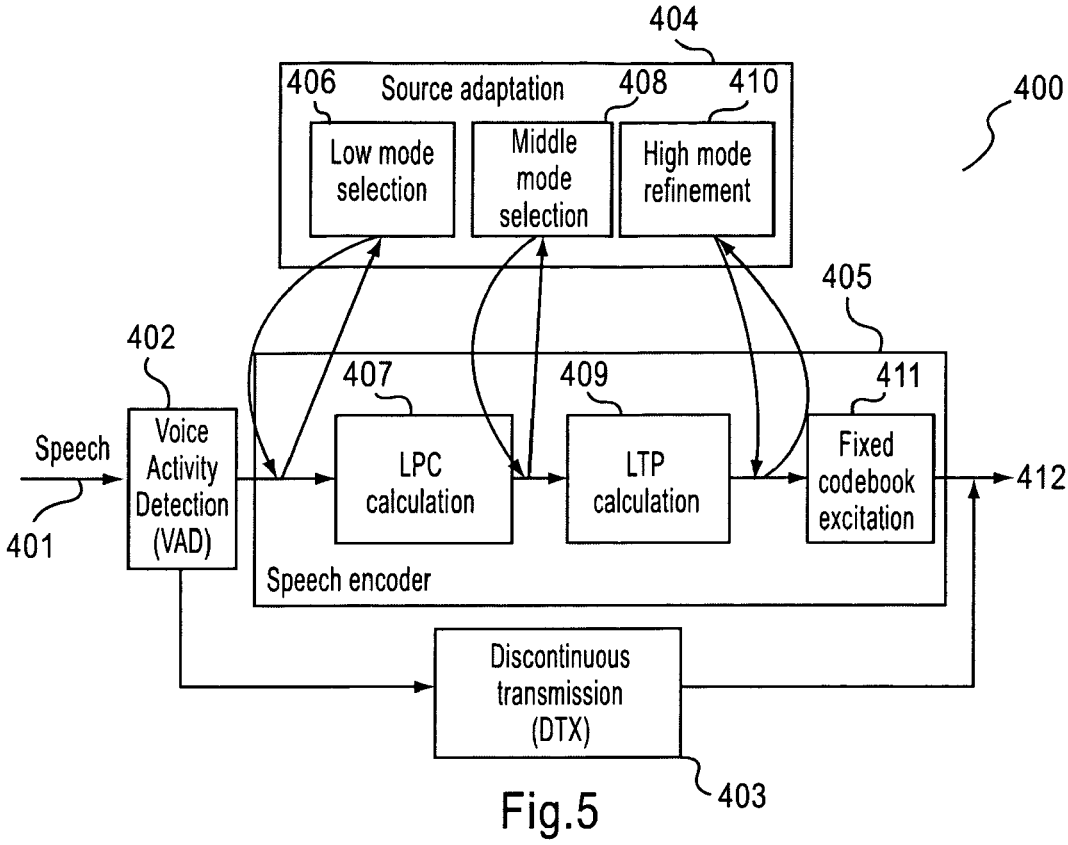
FIG. 5 illustrates a block diagram of a preferred embodiment of the present invention.

FIG. 5 illustrates a block diagram of a multi-rate speech encoder module 400 in a preferred embodiment of the present invention, wherein the codec mode selection is delayed. Preferably, though not essentially, the speech encoder may operate with the AMR-WB speech codec together with SBRA. Alternatively, the speech encoder may also operate with the AMR speech codec or other suitable speech codec.

The multi-rate speech encoder module 400 may comprise a voice activity detection (VAD) module 402 connected to a speech encoder 405 and a discontinuous transmission (DTX) module 403. The VAD module receives a speech signal 401 and determines whether the speech signal comprises active speech or silence periods. During silence periods, the DTX module may be activated and onward transmission of the speech signal interrupted during the silence period. During periods of active speech, the speech signal may be transmitted to the speech encoder 405.

The speech encoder 405 may comprise a linear predictive coding (LPC) calculation module 407, a long term prediction (LTP) calculation module 407 and a fixed code book excitation module 411. The speech signal received by the speech encoder is processed by the LPC calculation module, LTP calculation module and fixed code book excitation module on a frame by frame basis, where each frame is typically 20 ms long. Each of the modules of the speech encoder determine the parameters associated with the speech encoding process. The output of the speech encoder consists of a plurality of parameters representing the encoded speech frame.

It should be appreciated that the speech encoder module may comprise other modules not illustrated in FIG. 5.

The speech encoder module 400 further comprises a source based rate adaptation (SBRA) algorithm module 404. The SBRA algorithm module comprises a low mode selection module 406, a middle mode selection module 408 and a high mode refinement module 410.

The low mode selection module examines the speech signal sent from the VAD module to the LPC calculation module and performs calculations based on this speech signal. The middle mode selection module examines the data sent from the LPC calculation module to the LTP calculation module, which may comprise LPC parameters, such as ISP parameters, and other parameters, and performs calculations based on this data. The high mode refinement module examines the data sent from the LTP calculation module to the fixed codebook excitation module, which may comprise LPC parameters, such as pitch delay parameters, gain parameters and an LTP filtering flag parameter, LTP parameters and other parameters, and performs calculations based on this data.

The low mode selection module 406, middle mode selection module 408 and high mode refinement module 410 are used to determine the codec mode for speech encoding. In a preferred embodiment of the invention, the AMR-WB codec is used and the codec modes available in AMR-WB are 6.60, 8.85, 12.65, 14.25, 15.85, 18.25, 19.85, 23.05 and 23.85 kbit/s.

Active speech signals are transmitted from the VAD module to the speech encoder 405. The low mode selection module 406 examines the speech signal on a frame by frame basis and determines whether the lowest codec mode, in this example the 6.60 kbit/s codec mode, is to be used. The lowest codec mode may need to be determined before generation and quantisation of the LPC parameters, such as the an ISP parameter, by the LPC calculation module 407, as the lowest codec mode may have a different LPC parameter characteristic compared with all other codec modes. In a preferred embodiment, the parameter characteristic is the bit size of the parameter. If the lowest mode is determined for encoding the speech signal, the remaining modules of the SBRA algorithm module, the middle mode selection module 408 and the high mode refinement module 410, may be bypassed for the remainder of encoding process. This is because there is only one lowest codec mode, so no further determination of codec modes is required.

If the speech frame requires a higher codec mode, the determination of the codec mode may be delayed until after LPC calculation but before LTP calculation and may be performed by the middle mode selection module 408.

Middle mode selection is when the use of a middle codec mode is determined, which in this example is the 8.85 kbit/s mode. This may be performed by the middle mode selection module 408, which examines the data output by the LPC calculation module. The middle mode may need to be determined before generation and quantisation of the LTP parameters, such as a LTP filtering flag parameter, a pitch delay parameter and a gain parameter, as the middle codec mode may have different LTP parameter characteristics compared with the higher codec modes. In a preferred embodiment, the parameter characteristic is the bit size of the parameter. If the middle codec mode, in this example the 8.85 kbit/s mode, is determined for encoding the speech frame, the remaining modules of the SBRA algorithm module are bypassed for the remainder of encoding process. This is because there is only one middle codec mode, so no further determination of codec modes is required. If speech frame requires a higher codec mode, the determination of the codec mode may be delayed until after LTP calculation but before excitation calculation and may be performed by the high mode refinement module 410.

High mode refinement is when the use of one of the higher codec modes is determined. In this example, the higher codec modes are 12.2, 14.25, 15.85, 18.85, 19.25, 23.05 23.85 kbit/s. The high mode may need to be determined before calculation and quantisation of the excitation signal, because all the higher modes have different excitation signal characteristics, also referred to as the algebraic codebook parameter characteristic. In a preferred embodiment, the algebraic codebook parameter characteristic is the bit size of the algebraic codebook parameter. The final decision as to which of the higher codec modes to use may be based the speech frame characteristics or the speech class.

Figure 6:
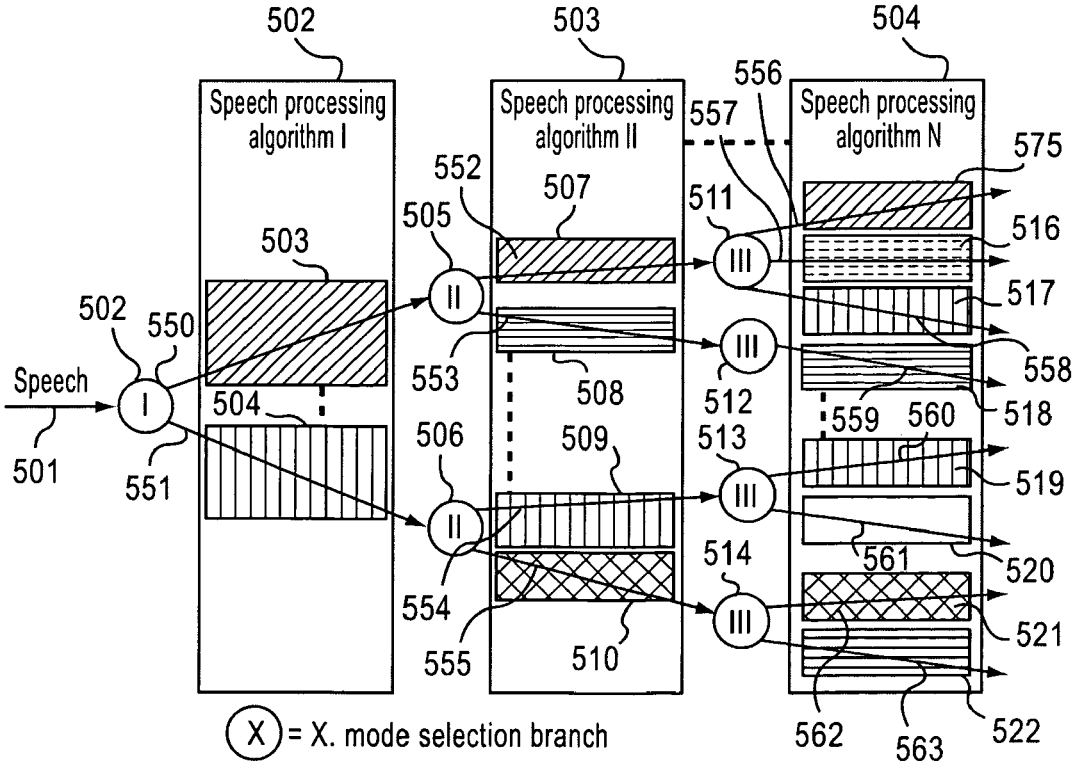
FIG. 6 illustrates a signal flow diagram of an arrangement of a preferred embodiment of the present invention.

FIG. 6 shows a signal flow diagram illustrating the processing that occurs between the SBRA algorithm module and the speech encoder in a preferred embodiment of the invention. The embodiment illustrated in FIG. 6 is a more general embodiment to that illustrated in FIG. 5.

In FIG. 6, speech encoding may be performed by a plurality of speech encoding algorithm groups on each speech frame. There are N speech processing algorithm groups: speech processing algorithm group I, 502, speech processing algorithm group II, 503, and speech processing algorithm group N, 504 illustrated in FIG. 6. It should be appreciated that other speech processing algorithm groups may be present that are not illustrated in FIG. 6. Speech processing algorithm group I may perform LPC calculations, such as calculating ISP parameters, and may be implemented in the LPC calculation module 407. Speech processing algorithm group II may perform LTP calculations, such as calculating LTP filtering flag parameters, pitch delay parameters and gain parameters, and may be implemented in the LTP calculation module 409. Speech processing algorithm group N may perform excitation calculations, such as calculating algebraic codebook parameters, and may be implemented in the fixed code book excitation module 411.

Each speech algorithm group may comprise a plurality of speech processing algorithms. Each speech processing algorithm may perform different calculations and/or calculate different speech encoding parameters, which may vary in their characteristics of bit size.

Speech processing algorithm group I comprises speech processing algorithm I-A, 503 and speech processing algorithm I-B, 504. Speech processing algorithm group II comprises speech processing algorithm II-A, 507, speech processing algorithm II-B, 508, speech processing algorithm II-C, 509, and speech processing algorithm 1I-D, 510. Speech processing algorithm group N comprises speech processing algorithm N-A, 515, speech processing algorithm N-B, 516, speech processing algorithm N-C, 517, speech processing algorithm N-D, 518, speech processing algorithm N-E, 519, speech processing algorithm N-F, 520, speech processing algorithm N-G, 521, and speech processing algorithm N-H, 522.

The signal flow diagram of FIG. 6 also includes a first mode selection branch point 502, a plurality of second mode selection branch points 505 and 506, and a plurality of third mode selection branch points 511, 512, 513 and 514.

The first mode selection branch point 502 is located before speech processing algorithm group I and may correspond to the determining of a codec mode by the low mode selection module 406. The first mode selection branch point receives a speech frame 501 and determines whether one of the higher codec modes or one of the lower codec modes should be used for encoding the speech frame. If one of the higher codec modes is determined, the speech frame follows path 550 and is encoded by speech processing algorithm I-A 503. If one of the lower codec modes is determined, the speech frame follows path 551 and is encoded by speech processing algorithm I-B. In the preferred embodiment, the lower and higher codec modes have a different LPC parameter characteristic such as the bit size of the LPC parameter.

The second mode selection branch points 505 and 506 are located before speech processing algorithm group II and may correspond to the determining of a codec mode by the middle mode selection module 408. The second mode selection branch points receive speech frames from speech processing algorithm group I and determines more specifically which ones of the higher or lower codec modes should be used for encoding the speech frame. In the preferred embodiment, the determined codec modes have a different LTP parameter characteristic such as the bit size of the LTP filtering flag, the pitch delay or the gain parameter.

The third mode selection branch points 511, 512, 513 and 514 are located before speech processing algorithm group III and may correspond to the determining of a codec mode by the high mode refinement module 410. The third mode selection branch points receive speech frames from speech processing algorithm group II and determines exactly which codec mode should be used for encoding the speech frame, and completes the encoding of the speech frame accordingly. In the preferred embodiment, the determined codec modes have a different algebraic codebook parameter characteristic such as the bit size of the algebraic codebook parameter.

In the preferred embodiment of the present invention, the determination on the codec mode to use is delayed as long as possible. During this delay more information can obtained from the speech frame, such as LPC and LTP information, which provides a more accurate basis for codec mode selection than in previously known SBRA systems.

In a further embodiment of the present invention, the SBRA algorithm exploits the speech encoding parameters determined from the current and previous speech frames for classifying the speech. Therefore, the codec mode selection, which is dependent on speech class, may be dependent on the speech encoding parameters from the current speech frame and the previous speech frames.

The SBRA algorithm may compare the determined encoded speech parameters, such as the LPC, LTP and excitation parameters, against thresholds. The values to which these thresholds are set may depend on the target bit rate. The thresholds used by the SBRA algorithm for codec mode selection may be stored in a tuning codebook (CB). The tuning CB can be represented as a matrix, TCB, where each row includes a set of tuned thresholds for a given codec mode. For example:

$$TCB = \begin{bmatrix} p_{TCB}^{X_1,1} & p_{TCB}^{X_1,2} & \cdot & \cdots & p_{TCB}^{X_1,m} \\ p_{TCB}^{X_2,1} & \cdot & & & \cdot \\ \cdot & & \cdot & & \cdot \\ \cdot & & & \cdot & \cdot \\ p_{TCB}^{X_n,1} & \cdot & \cdot & \cdots & p_{TCB}^{X_n,m} \end{bmatrix}$$

where the columns of TCB are the set of tuned values for certain threshold. For example, the element $p_{TCB}^{X_r,a}$ from TCB indicates ath tuning parameter, for example the ISP parameter, for the codec mode of $X_r$ kbps. An index pointing towards the first row gives the set of parameter thresholds for the highest codec mode $X_1$, and the index pointing towards the last row gives the set of parameter thresholds for the lowest codec mode $X_n$.

The active mode set is the group of codec modes which may be available for encoding. This may be determined by network conditions such as the capacity of the network. The codec modes are sequenced in growing bit rate order, where $M_1^{set}$ is the codec mode with lowest coding rate. An example of an active mode set is as follows:

$$M^{set}=[4.75 \text{ kbps } 5.90 \text{ kbps } 7.40 \text{ kbps } 12.2 \text{ kbps}]$$

Operation mode refers to the highest mode in the active codec set. This mode may be determined by the channel conditions, such as by link adaptation.

The tuning CB is therefore dependent on the active mode set, and in particular the available codec modes.

The SBRA algorithm may compare each of the parameters from the encoding of a speech frame and determine which set of parameter thresholds in the tuning CB are met. The codec mode for which all the parameters in the tuning CB have been met is selected as the preferred codec mode. The parameter thresholds are generally set so that at least one of the codec modes can be selected.

Network constraints such as network capacity and other transmission considerations can mean that the actual bit rate of the selected codec may not be the same as the target bit rate.

The SBRA algorithm may be either a closed loop system or an open loop system. In an open loop system, the specific thresholds for each parameter in the tuning CB are set when the target bit rate is set or changed. In a closed loop system, the specific thresholds for each parameter may also vary according to the difference between target bit rate and the actual bit rate or the bit rate of the codec selected. Therefore, feedback in a closed loop system may provide for more accurate convergence towards the target bit rate compared to an open loop system.

In AMR and AMR-WB, VAD is typically used to help in lowering the bit rate during silence periods. However, active speech is coded by a codec mode selected according to network capacity and radio channel conditions. According to another embodiment of the present invention, SBRA algorithm may be implemented as an extension to VAD rather than in a separate module. The complexity of the extension may be kept very low compared to previous SBRA algorithms, as some of the parameters used by the SBRA algorithm in determining codec mode selection are obtained from calculations made by the VAD algorithm. This may result in higher capacity networks and storage applications while maintaining the same speech quality.

Figure 7:
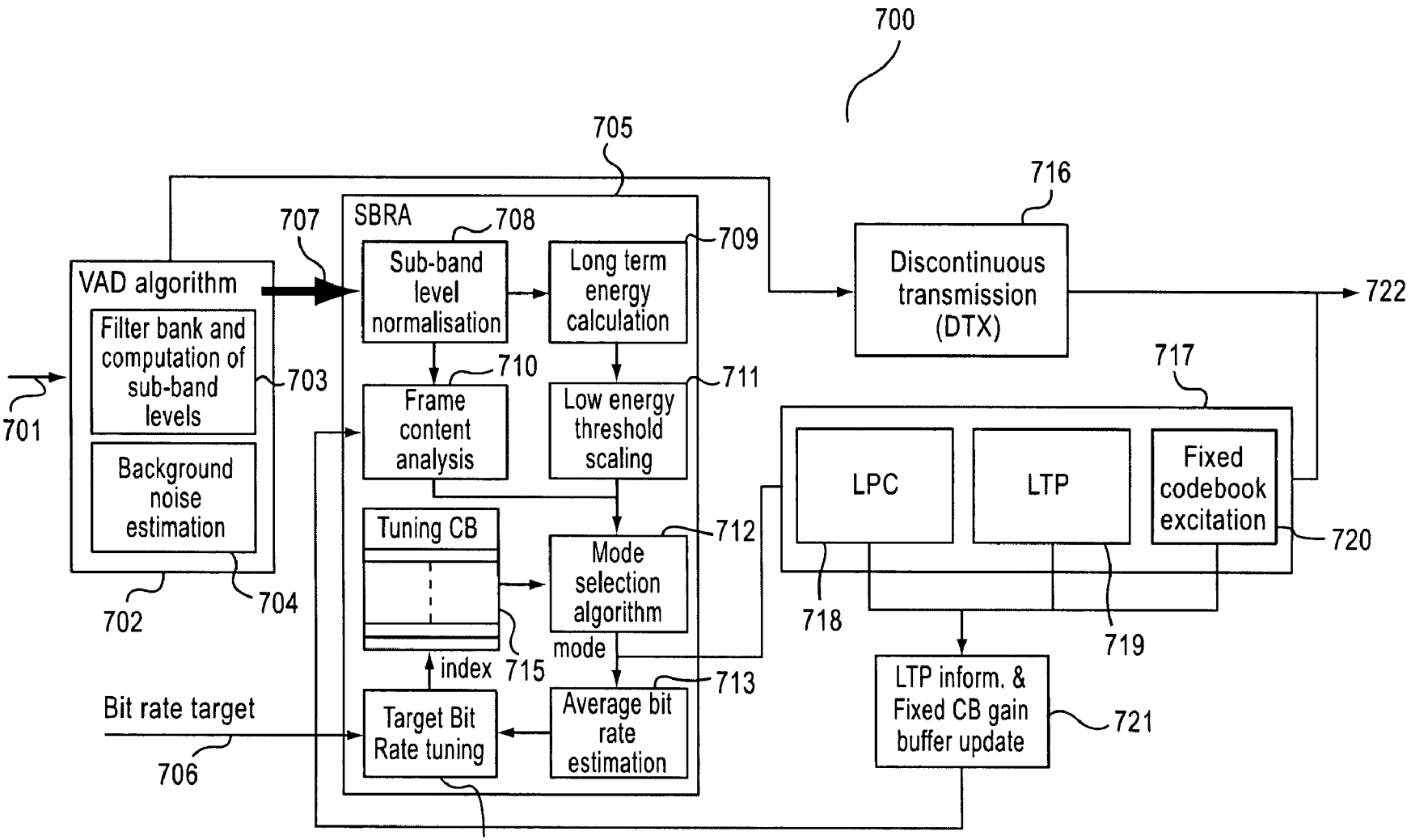
FIG. 7 illustrates a block diagram of a further embodiment of the present invention.

FIG. 7 illustrates a block diagram of another embodiment of the present invention. FIG. 7 illustrates a VAD module 702, a SBRA algorithm module 705, a DTX module 716 and a speech encoder 717.

The VAD module 702 comprises a filter bank module 703, which may be used for the computation of parameters such as the sub-band, or frequency band, energy levels in a speech frame, and a background noise estimation module 704, which may be used for the computation of parameters such as background noise estimates for a speech frame. The VAD module receives a speech frame 701 and determines whether the frame comprises active speech or silence periods. This is done by analysing the energy levels of each sub-band of the speech frame at the filter bank module and analysing the background noise estimate at the background noise estimation module. A VAD flag corresponding to the presence of a silence frame or period is set depending on the result of the analysis. For silence periods, the DTX module is activated and transmission interrupted during the silence period. For active speech, the speech frame may be provided to the SBRA algorithm module via connection 707. Preferably, parameters from the analysis by the filter bank module and the background noise estimation module are also transmitted to the SBRA algorithm module for use in calculations by the SBRA algorithm module. The SBRA algorithm module may use at least some of these parameters for its calculations without the need to calculate them separately.

It should be appreciated that whilst the parameters from the VAD algorithm module are illustrated as being provided to the SBRA algorithm module via connection 707 in FIG. 7, this provision may be done by directly transmitting the parameters between the modules or by storing the parameters in suitably configured medium such as in a memory or a buffer, which can be accessed by both the VAD algorithm module and the SBRA algorithm module.

The SBRA algorithm module comprises a sub-band level normalisation module 708, a long term energy calculation module 709, a frame content analysis module 710, a low energy threshold scaling module 711, a mode selection algorithm module 712, an average bit rate estimation module 713, a target bit rate tuning module 714 and a tuning CB module 715.

Sub-band level normalisation is performed by the sub-band level normalisation module 708 for active speech frames. The table below illustrates the typical band levels of a speech frame and the associated frequency range:

| Band number | Frequencies |
|---|---|
| 1 | 0-250 Hz |
| 2 | 250-500 Hz |
| 3 | 500-750 Hz |
| 4 | 750-1000 Hz |
| 5 | 1000-1500 Hz |
| 6 | 1500-2000 Hz |
| 7 | 2000-2500 Hz |
| 8 | 2500-3000 Hz |
| 9 | 3000-4000 Hz |

The total energy, $totalEnergy^j$, of all bands in the jth speech frame is given by:

$$totalEnergy^j = \sum_{i=1}^{9} (\text{vad_filt_band}_i^j - \text{bckr_est}_i^j)$$

and calculated by the sub-band level normalisation module.

Normalisation of the energy levels in each sub-band of the speech frame is calculated as follows:

$$NormBand_i^j = \frac{(\text{van_filt_band}_i^j - \text{bckr_est}_i^j)}{totalEnergy^j},$$

where $NormBand_i^j$ is the normalised Ah band of jth speech frame. The parameters, $\text{bckr_est}_i^j$ and $\text{vad_filt_band}_i^j$, are the background noise estimate and energy level of ith band in jth speech frame respectively.

The background noise estimate, $\text{bckr_est}_i^j$, and the energy levels, $\text{vad_filt_band}_i^j$, are preferably provided by the background noise estimation module 704 and filter bank module 703 respectively. These parameters may be provided by the background noise estimation module and filter bank module of the VAD algorithm module to the SBRA algorithm module via connection 707.

The normalization of the energy levels from the calculated by the sub-band level normalization module 708 may then be used by the frame content analysis module 710. The frame content analysis module performs frame content analysis for each speech frame, where the frequency content of a speech frame is determined. One of the variables calculated is the average frequency of the speech frame. The average frequency of the speech frame may be calculated based on parameters obtained from the sub-bands energy level calculations from the filter bank module 703. The parameters from the sub-band energy level calculations, such as the sub-band energy levels, are preferably passed from the filter bank module 703 to the frame content analysis module 710 and therefore do not need to be calculated by the frame content analysis module separately.

Other parameters calculated by the frame content analysis module include speech stationarity, the maximum pitch difference stored in the LTP pitch lag buffer and the energy level difference between the current and previous speech frames.

The long term energy calculation module 709 estimates a value for the long term energy of the active speech signal level by analyzing each speech frame together with the parameters from the sub-band level normalization module. The estimated value of the long term energy is used by the low energy threshold scaling module 711. The low energy threshold scaling module 711 is used for detecting low energy speech sequences for use in mode selection by the mode selection algorithm module.

The average bit rate estimation module 713 calculates the average bit rate of previous frames, for example, the last 100 frames. The average bit rate is used to tune the target bit rate, which is performed by the target bit rate tuning module 714. The target bit rate tuning module receives a bit rate target 706, which may be determined by link adaptation for example, and controls the average bit rate and tuning parameters for the tuning codebook module 715.

The mode selection algorithm module 712 determines the codec mode to be selected for speech encoding. The module uses parameters calculated by the other SBRA algorithm modules, such as the tuning codebook module 715, the low energy threshold scaling module 711, the long-term energy calculation module 709 and frame content analysis module 710 to select a codec mode. The codec mode selected is passed to the speech encoder 717, which encodes the speech frame accordingly. LTP information and fixed codebook gain information 721 obtained during speech encoding can be fed back to the frame content analysis module 710.

In the preferred embodiment, the SBRA algorithm module, and in particular, the sub-band level normalisation module and the frame content analysis module, can utilise parameters provided by the filter bank module and the background noise estimation modules of the VAD module. As such, these parameters do not need to be calculated separately by the SBRA algorithm module, resulting in an SBRA algorithm module that is simpler to implement compared to previously known ones, where the calculations performed by the VAD algorithm module and the SBRA algorithm module are entirely separate.

The embodiment provides a lower complexity method for determining codec mode than in previous SBRA systems, as at least some of the parameters used for determination are calculated in the VAD module. The computational part of the SBRA algorithm module can therefore kept to a minimum. This may also result in lower storage capacity requirements and require less resource for implementation compared to previous SBRA algorithm modules.

It should be noted that whilst the preceding discussion and embodiments refer to 'speech', a person skilled in the art will appreciate that the embodiments can equally be to other forms of signals such as audio, music or other data, as alternative embodiments and as additional embodiments.

It is also noted herein that while the above describes exemplifying embodiments of the invention, there are several variations and modifications which may be made to the disclosed solution without departing from the scope of the present invention as defined in the appended claims.

The invention claimed is:

1. A method, comprising:

encoding via at least one stage of a transceiver, said encoding being performed to encode a frame using at least one of a plurality of codec modes, wherein an encoded frame formed by at least one of said codec modes comprises a plurality of parameters, wherein said at least one stage comprises:

first, calculating values for said plurality of parameters of the encoded frame;

second, selecting one group of codec modes from a plurality of groups of codec modes using said calculated values of said parameters, wherein each of said groups of codec modes comprises at least one speech processing algorithm and comprises a common parameter characteristic, wherein the selection is performed according to at least one of prior to calculating a linear prediction coding operation, after calculating a linear prediction coding operation and prior to calculating a long term prediction operation, and after calculating a linear prediction coding operation and a long term prediction operation; and third, encoding the frame with at least one of the speech processing algorithms from the selected group of codec modes in dependence on said common parameter characteristic.

2. A method as claimed in claim 1, comprising a plurality of said stages.

3. A method as claimed in claim 1, wherein the parameters comprise one or more of: a voice activity detection flag, a long term prediction filtering flag parameter, an immitance spectral pair parameter, a pitch delay parameter, an algebraic codebook parameter, a gain parameter and a high-band energy parameter.

4. A method as claimed in claim 3, wherein the parameter characteristic is a bit size of the parameter.

5. A method as claimed in claim 1, wherein the frame is a speech frame.

6. A method as claimed in claim 1, wherein the selected group consists of one or more of said codec modes.

7. A method as claimed in claim 1, wherein the selecting said one codec mode group is in dependence on determined parameters determined from the encoding of the frame.

8. A method as claimed in claim 7, wherein the determined parameters are compared to threshold values.

9. A method as claimed in claim 8, wherein the one of the codec modes selected to encode the frame is dependent on the comparison of the threshold values.

10. A method as claimed in claim 8, wherein the threshold values are dependent on a target bit rate.

11. A method as claimed in claim 8, wherein the threshold values are stored in a tuning table, the tuning table comprising threshold values for each of the parameters corresponding to each of the plurality of codec modes.

12. A method as claimed in claim 1, wherein each of the plurality of codec modes defines a bit rate for encoding the frame.

13. A method as claimed in claim 1, wherein said at least one stage being arranged to have a group with a codec mode with a lowest bit rate and another group with remaining codec modes.

14. A method as claimed in claim 13 comprising at least two stages, wherein said first stage being arranged to have two groups and said second stage being arranged to have at least three groups, wherein at least two of the groups of the second stage are contained in one of the groups of the first stage.

15. A method as claimed in claim 14 comprising three stages, wherein in said third stage, said frame is encoded by one of said plurality of codec modes.

16. A method as claimed in claim 1, wherein the plurality of codec modes are codec modes of an adaptive multi rate codec.

17. An apparatus, comprising:

an encoder configured to calculate values of a plurality of parameters of a frame, wherein the frame is configured to be encoded using at least one of a plurality of codec modes, wherein an encoded frame formed by at least one of said codec modes comprises said plurality of parameters; and selecting circuitry configured to select, after said calculation of the frame parameters, one group of codec modes from a plurality of groups of codec modes based on said calculated values of said parameters, wherein each of the groups of codec modes comprises at least one speech processing algorithm and comprises a common parameter characteristic, wherein the selection is performed according to at least one of prior to calculating a linear prediction coding operation, after calculating a linear prediction coding operation and prior to calculating a long term prediction operation, and after calculating a linear prediction coding operation and a long term prediction operation, and wherein the encoder is further configured to encode, after said selecting of the group of codec modes, the frame with at least one of the speech processing algorithms from the selected group of codec modes in dependence on said common parameter characteristic.

18. An apparatus as claimed in claim 17, wherein the parameters comprise one or more of: a voice activity detection flag, a long term prediction an filtering flag parameter, an immitance spectral pair parameter, a pitch delay parameter, an algebraic codebook parameter, a gain parameter and a high-band energy parameter.

19. An apparatus as claimed in claim 18, wherein the parameter characteristic is a bit size of the parameter.

20. An apparatus as claimed in claim 17, wherein the frame is a speech frame.

21. An apparatus, comprising:

processing means for calculating values for a plurality of parameters of a frame, wherein the frame is configured to be encoded using at least one of a plurality of codec modes, wherein an encoded frame formed by at least one of said codec modes comprises said plurality of parameters, which comprise one or more of a voice activity detection flag, a long term prediction filtering flag parameter, an immitance spectral pair parameter, a pitch delay parameter, an algebraic codebook parameter, a gain parameter and a high-band energy parameter;

selecting means for selecting from a plurality of groups of codec modes one group of codec modes based on said calculated values of said parameters, wherein each of said groups of codec modes comprises at least one speech processing algorithm and comprises a common parameter characteristic, wherein the selecting is performed according to at least one of prior to calculating a linear prediction coding operation, after calculating a linear prediction coding operation and prior to calculating a long term prediction operation, and after calculating a linear prediction coding operation and a long term prediction operation; and encoding means for receiving information identifying said selected group of codec modes and encoding the frame with at least one of the speech processing algorithms from the selected group of codec modes in dependence on said common parameter characteristic.

* * * * *